US005855036A

United States Patent [19]

Krock

[11] Patent Number: 5,855,036

[45] Date of Patent: Jan. 5, 1999

[54] STATIC DISSIPATIVE VACUUM WAND

[76] Inventor: Richard P. Krock, c/o CD Wands Company, 31358 St. Andrews, Westlake, Ohio 44145

[21] Appl. No.: 738,833

[22] Filed: Oct. 28, 1996

[51] Int. Cl.[6] ..... A47C 9/02

[52] U.S. Cl. ..... 15/420; 15/339; 15/415.1

[58] Field of Search ..... 15/415.1, 339, 15/420; 361/212, 215, 220

[56] References Cited

U.S. PATENT DOCUMENTS

| | | | |
|---|---|---|---|
| 3,713,280 | 1/1973 | Keller et al. | 361/220 X |
| 3,982,157 | 9/1976 | Azuma et al. | 361/213 |
| 4,193,105 | 3/1980 | Graafmann | 361/215 |
| 4,319,303 | 3/1982 | Thorn | 361/213 |
| 4,394,705 | 7/1983 | Blachman | 361/215 |
| 4,697,300 | 10/1987 | Warlop | 15/339 X |
| 4,715,085 | 12/1987 | Johanson | 15/339 |
| 4,715,086 | 12/1987 | Johanson et al. | 15/339 |
| 4,866,565 | 9/1989 | Wray | 15/339 X |
| 5,150,499 | 9/1992 | Berfield | 15/339 X |
| 5,511,840 | 4/1996 | Allison et al. | 361/220 X |

*Primary Examiner*—Chris K. Moore

[57] ABSTRACT

A wand for use in a vacuum system that is made from rigid or non-rigid polymeric materials that have static dissipative qualities so that any static discharge event will be at low enough energy levels so as not to pose a hazard to humans and will be well below the minimum ignition energy for many industrial powders and dusts.

8 Claims, 2 Drawing Sheets

STATIC DISSIPATIVE VACUUM WAND

BACKGROUND

The present invention relates to static discharge devices and, more particularly, to machinery components having static electricity dissipative qualities.

In industrial settings, vacuum systems are widely used to pneumatically transfer bulk solids from one container to another, to meter solids from a container into a process, and to sweep up powder spills, leaks or dust accumulations. A flexible hose is commonly attached to the vacuum unit and at the end of the flexible hose is a rigid tubular device (cylindrical or polygon in shape) typically referred to as the vacuum wand. The wand is used by a human operator to direct the point of entry into the vacuum system where the accumulation of powder, bulk solids, or dust may be greatest. Metallic wands made from steel, stainless steel, aluminum, copper, or other metals are normally used because of their rigidity and their ability to be grounded by a wire to earth ground. Polymeric wands are not used, even though they are rigid enough to function as a wand, because of their characteristic of developing a large static electric charge which does not transfer to earth ground.

Static electric charge can build up on any isolated ungrounded material or device. In a vacuum or pneumatic conveying system, particles transfer electrons when they come in contact with other particles or materials. This is referred to as triboelectric charging. The amount of charge and the type of charge (positive or negative) depends on the speed of contact, the intimacy of contact, and the relative position of the two materials in the triboelectric series.

Polymeric materials (plastics) are normally used as electrical insulators because of their ability to prevent a flow of electrons through the bulk of the material. Insulative materials have surface resistivities greater than $10^{14}$ ohms per square (e.g. cm.), and volume resistivities greater than $10^{14}$ ohms-cm. The high molecular weights of polymers and their amorphous or low crystalinity molecular structure allow pockets of electrons to accumulate and not to evenly distribute electrons across the surface or through the bulk of the material. As a result, earth grounds attached to vacuum wands made with insulative polymeric materials are not effective in allowing the static charge build up to flow to earth ground. On the other hand, metals have surface resistivities of about $10^{-3}$ ohms per square (e.g. cm.)and volume resistivities near $10^{-3}$ ohms-cm which is considered in the category of electrical conductors and this allows instantaneous discharge of the entire static charge build up throughout the wand to flow to earth ground.

A shortcoming of metallic wands however is that earth grounds are 1) not connected at all; 2) not connected properly; 3) the conductive wire breaks at a point away from the wand; or 4) the conductive wire is so long to earth ground or too small in diameter to the point that the static charge being generated at the wand can more easily discharge itself directly off the wand to the operator or another grounded device. Static electric shocks to operators are common experiences and are painful. Static electric sparks can be an ignition source in an atmosphere with an explosive concentration of dust particles and may cause a hazardous explosion. Metal wands are so conductive that in the event of improper grounding, the entire amount of static charge, which can easily reach 10,000 volts in a 48" long by 2" diameter wand, is released instantaneously in a few milliseconds. This represents an energy release of 24 millijoules which is above the minimum ignition energy value for many powders and dusts. Humans are sensitive to static electric shocks above 3,000 volts. So an ungrounded or improperly grounded metallic vacuum wand can be a nagging source of operator pain and can represent a safety hazard when conditions are just right for a dust explosion. Accordingly, there is a need for an entry tube or vacuum wand that will not be a hazard, even when not properly grounded.

SUMMARY

The object of the present invention is to provide a vacuum wand that preserves employee welfare from painful static electric shocks and protects against a static discharge event that could cause a dust explosion. The object of this invention is achieved in one aspect through the use of a static dissipative rigid or semi-rigid polymeric material for the construction of the vacuum wand. The static dissipative plastic should have the proper surface and volume resistivity to prevent rapid and instantaneous transfer of static charge that may build up on a vacuum wand during normal use. Another quality is uniformity of electrical properties on the surface or through the bulk of the material so that static charge build upon the vacuum wand can migrate along the surface or through the bulk of the material to an appropriate earth ground. The ranges of resistivity for this static dissipative material should be $10^5$ to $10^{14}$ ohms per square (e.g. cm.) surface resistivity, or $10^5$ to $10^{14}$ ohms-cm volume resistivity, but preferably in the $10^8$ to $10^{12}$ range for both resistivities.

Several rigid or semi-rigid polymers are available that satisfy this resistivity range where either polyether chemistry is alloyed with polyimides, or amines, or quaternary ammonium salts are blended to form a homogenous mixture in polypropylene, polyethylene, polyvinyl chloride, acrylonitrile-butadiene-styrene (ABS), polycarbonate, or polystyrene polymers, or polycarbonate/acrylonitrile-butadiene-styrene (PC/ABS) copolymers to create an ionically dissipative plastic compound. Static dissipative compounds that incorporate carbon black, carbon fibers, metallic fibers, or metallic flake are also available in these aforementioned polymers and satisfy the required resistivity characteristics. The hardness of a polymer as measured on a Rockwell C scale is used to differentiate polymers as being rigid or non-rigid. Non-rigid polymers are normally characterized by a Rockwell C hardness number of between 30 and 65 and rigid polymers are normally characterized by numbers greater than 65.

Vacuum wands made from these types of static dissipative materials have an unexpected low energy release of less than 10 millijoules when discharged to each ground after being charged up to their capacitative limit. Unlike in metallic wands, the built-in resistance of the static dissipative material slows down the energy release from a static dissipative wand when static charge is transferred to a person or another object and as a result, the corresponding discharge event occurs in a low energy state.

BRIEF DESCRIPTION OF THE DRAWINGS

The invention will be further explained with the aid of the accompanying drawings in which.

DETAILED DESCRIPTION

Figure 1A:
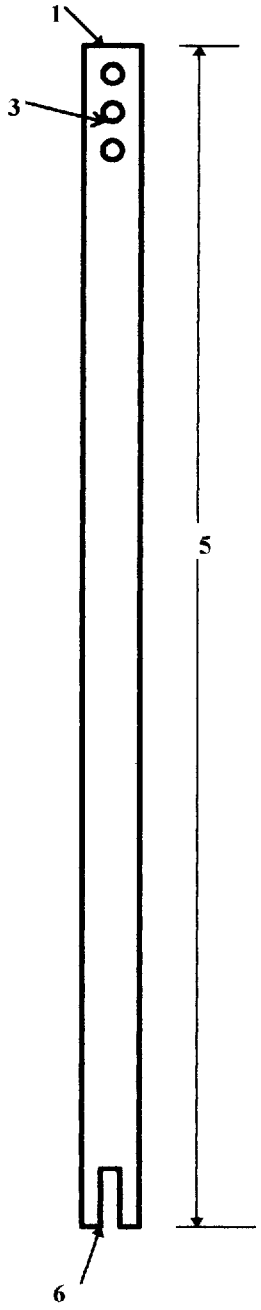
FIGS. 1A and 1B are side views of two styles of static dissipative vacuum wands for incorporating the invention.
Figure 1B:
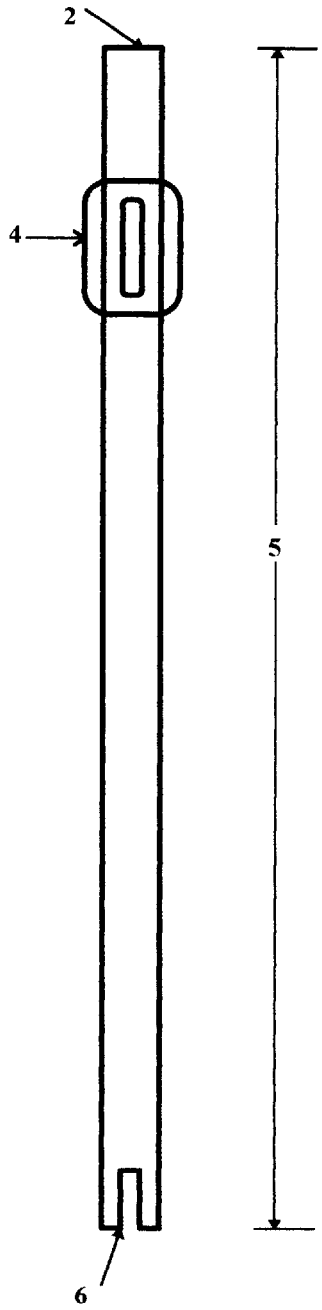
Figure 2A:
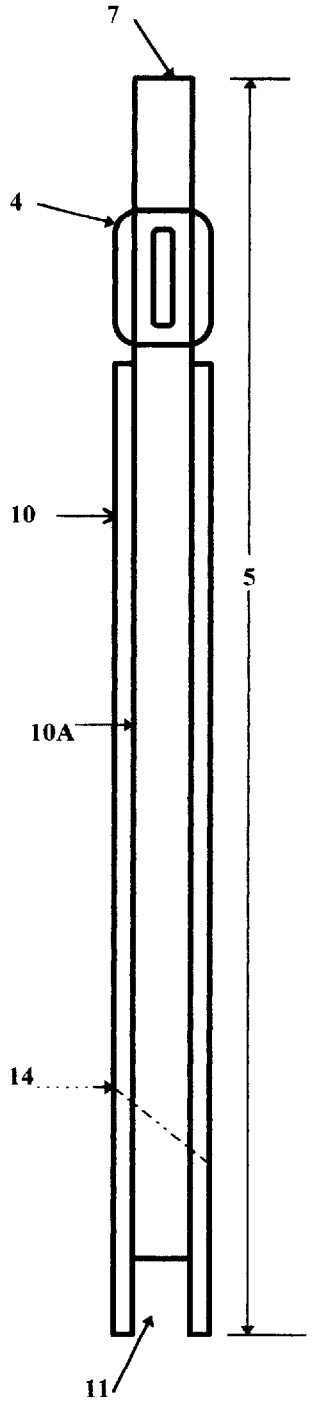
FIGS. 2A and 2B are side views of two styles of static dissipative vacuum wands incorporating the invention and which utilize outer air.
Figure 2B:
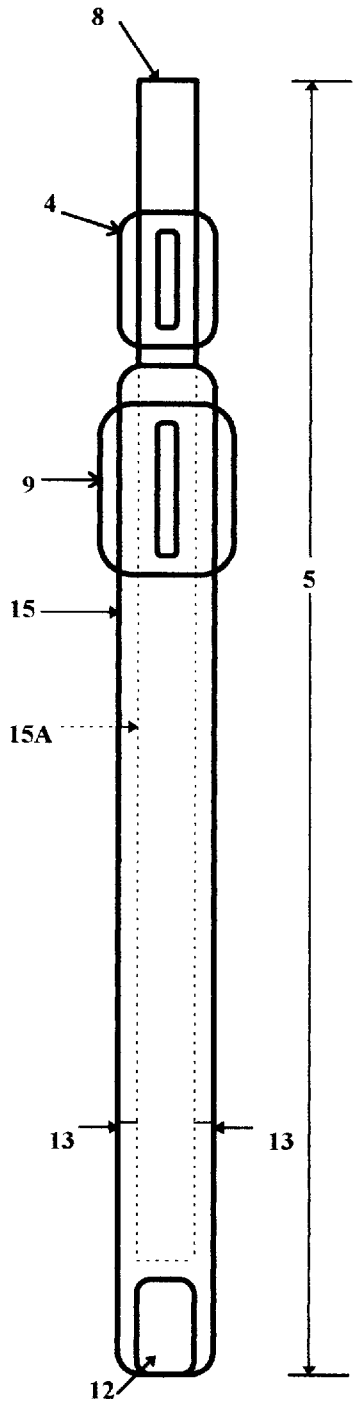

As shown in FIGS. 1A, 1B, 2A and 2B, in a preferred embodiment of the present invention, static dissipative rigid or semi-rigid polymers with the proper surface and volume resistivity are extruded into cylindrical tubes ranging in diameter from 0.25" to 12" depending on the size of vacuum unit or extruded into other non-cylindrical shapes having cross-sectional profiles such as triangular, quadrangles, or other polygons that would serve as a conduit for two phase air/solid flow and cut in lengths 5 of between 6" and 120" for the appropriate application for the style of wands 1, 2, 7 and 8. For regulating the amount of vacuum pulled in the wand, air holes 3, or air flow adjusters 4 (FIG. 1B) fabricated with slot type openings and cover screens fastened by retainer bushings and flexible O-rings can be added. For vacuum wand style 8 (FIG. 2B) that has an outer annular air tube 15 for supplying air to the tip of the wand while it is inserted in high bulk density powders, an outer air register 9 similar to that fabricated for air flow adjuster 4 can be added to control the fluidizing air supply volume that finds its way into the vacuum wand. Since many containers utilize a plastic liner to hold and protect the powder or pellets, the bottom treatment of the static dissipative vacuum wand is fabricated in order to prevent sucking the liner into the wand by adding a notch 6 (FIGS. 1A, 1B) that diverts the air into the tubular space ahead of the end tip or by extending the outer air channels 11 (FIG. 2A) or outer annular tube 12 (FIG. 2B) to create a vacuum breaker effect. In the case of vacuum wand style 8 that has outer and inner concentric tubes 15 and 15A respectively, it is necessary to stabilize the inner tube at its tip with set screws 13. As shown in FIG. 2A, for sweeping dust up from a floor or other flat surface, wand 7 may include a bias cut 14 (shown in phantom) at an angle of between 20 and 70 degrees across the entire bottom of outer and inner tubes 10, 10A, respectively, which will allow fluidizing air the pick up the particles from the surface.

The static dissipative vacuum wand so constructed will release its static electric charge build-up in a controlled manner and over a controlled period of time so that the discharge event is at a low energy level, making it a much safer vacuum wand than those of metallic construction in the event that the ground wire is not functional or does not exist.

An additional benefit when the static dissipative plastic material has an impact resistance of at least 1 to 20 ft.-lb/in. notched izod impact, the static dissipative vacuum wand can absorb impact of materials traveling through it and consequently be more gentle on friable materials than when conveyed through metallic wands. If so properly extruded the tubular vacuum conduit will have a smoother inner surface that will also be more gentle on friable solid materials being conveyed than that surface typically found in a metallic tube.

What is claimed is:

1. A wand for pneumatic transfer of bulk solids comprising:

a tubular member adapted to be attached to a vacuum hose and being made entirely of a rigid, non-flexible static dissipative polymeric material free of metal or carbon having a volume resistivity in the range of $10^{10}$ to $10^{12}$ ohm-cm and a surface resistivity in the range of $10^{10}$ to $10^{12}$ ohm per square centimeter.

2. The wand of claim 1 wherein said wand includes outer air channels that comprise a concentric tube element attached to and in contact with the tubular member that is attached to a vacuum hose for feeding ambient air to the tip of the wand for fluidizing bulk solid material.

3. A wand for pneumatic transfer of bulk solids comprising:

a tubular member adapted to be attached to a vacuum hose and being made entirely of a rigid, non-flexible static dissipative polymeric material free of metal or carbon and having a volume resistivity in the range of $10^{10}$ to $10^{12}$ ohm-cm and a surface resistivity in the range of $10^{10}$ to $10^{12}$ ohm per square centimeter; and a concentric tube element attached to and in contact with the tubular member and having outer air channels for feeding ambient air to the tip of the wand for fluidizing the bulk solid material.

4. The wand of claim 3 wherein the outer air channels are made entirely of rigid, non-flexible static dissipative polymeric material containing no metal or carbon.

5. The wand of claim 3 that further comprising a notch at the bottom of the tubular member of the wand.

6. The wand of claim 3 further comprising a notch formed by extending the outer air channels beyond the end of the tubular member of the wand.

7. The wand of claim 3 further comprising perforations for ambient air entry found at the hose connection end of the tubular member.

8. The wand of claim 3 further comprising an adjustable air register having an outer concentric tube with an aperture attached to and in contact with the tubular member of the wand; said air register feeding ambient air to the inside of the tubular member of the wand for controlling the pickup and fluidization of the bulk solid material;

said tubular member having a matching aperture over which the outer air register is positioned near the hose connection end;

said air registers being made of a rigid, non-flexible static dissipative polymeric material containing no metal or carbon.

* * * * *